United States Patent [19]

Bogner et al.

[11] Patent Number: 4,529,218

[45] Date of Patent: Jul. 16, 1985

[54] SKI BINDING PART

[75] Inventors: Martin Bogner, Ostfildern; Georg Scheck, Leonberg, both of Fed. Rep. of Germany

[73] Assignee: Geze GmbH, Fed. Rep. of Germany

[21] Appl. No.: 369,649

[22] Filed: Apr. 19, 1982

[30] Foreign Application Priority Data

Jun. 6, 1981 [DE] Fed. Rep. of Germany ..... 3122653

[51] Int. Cl.[3] ..... A63C 9/084

[52] U.S. Cl. ..... 280/632

[58] Field of Search ..... 280/631, 632, 634, 628, 280/626

[56] References Cited

U.S. PATENT DOCUMENTS 3,572,739 3/1971 Erlebach ..... 280/628

FOREIGN PATENT DOCUMENTS 2071437 9/1971 France ..... 280/626

2480130 10/1981 France ..... 280/628

*Primary Examiner*—Joseph F. Peters, Jr.

*Assistant Examiner*—Joseph G. McCarthy

[57] ABSTRACT

The ski binding part consists essentially of a fulcrum part (1) which is affixed to the ski or displaceable thereon against a biasing spring (5) and on which a latch (2) is fulcrumed on a transverse axis (3) of the ski for the purpose of gripping the heel of the ski boot. On the side of the fulcrum (1) facing away from the boot, a thrust block (10) is displaceably guided on or in the latch and cooperates with a counterthrust member (13) integral with the latch. The longitudinal central axis (M) of the thrust block is disposed at a radial distance (a) below the fulcrum axis (3).

9 Claims, 4 Drawing Figures

SKI BINDING PART

BACKGROUND

Figure 1:
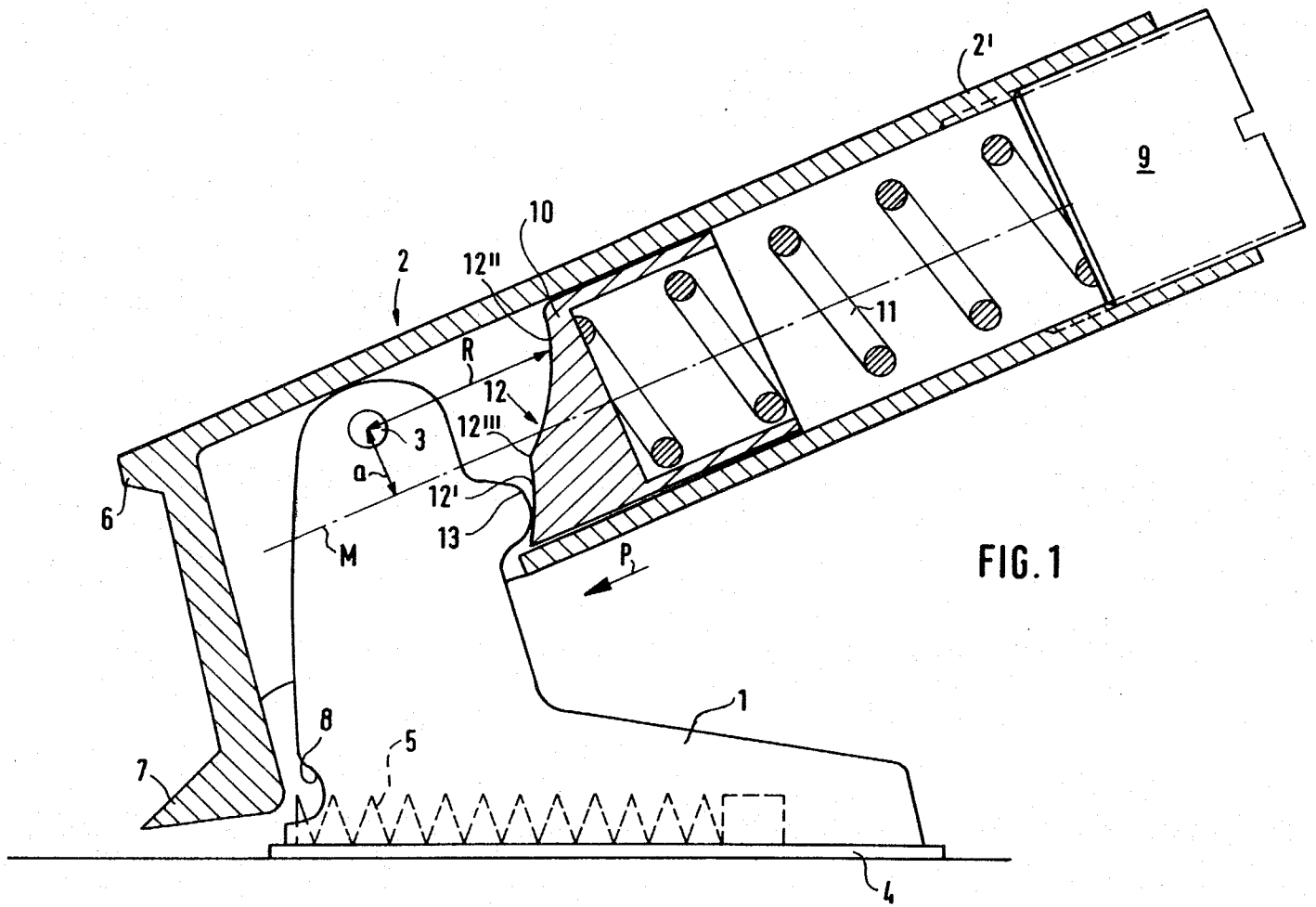

The invention relates to a part of a ski binding, especially a heel gripper, having a latch which is fulcrumed about at least one pivot axis disposed transversely of the length of the ski on a fulcrum piece which is affixed to the ski or is displaceable lengthwise of the ski against a biasing spring, and which in the gripping position overreaches a part of the ski boot, such as the heel or the like, or overreaches a part which can be bound to the boot, such as a sole plate, and having a thrusting mechanism whose thrust block, in the form of a piston-like part for example, is guided in or on the latch, on the side facing away from the boot, for displacement transversely of the pivot axis against the force of a thrust spring, and cooperates with a counter-thrust member fixedly provided on the fulcrum block such that, when the latch is rocked in the boot-releasing direction, the thrusting mechanism offers a resistance producing a return moment which increases within a resiliency range of the ski binding part, but vanishes as the latch rocks beyond the resiliency range.

Such bindings are known from German Petty Pat. No. 1,986,426, German Pat. No. 1,205,875 and German Pat. No. 1,578,761. According to German Petty Pat. No. 1,986,426, the latch is fulcrumed about a transverse axis on a cylindrical fulcrum head on the fulcrum block. The cylindrical fulcrum head has a wedge-shaped detent recess which cooperates with a springloaded, piston-like detent disposed in the latch, which has an apex adapted to the wedge shape of the detent recess and is guided for longitudinal displacement radially to the fulcrum axis in the latch. The ski binding part described in German Pat. No. 1,205,875 differs from the foregoing essentially only in that, for the fulcruming of the latch on the fulcrum block a cylindrical shaft fixedly joined therewith is provided, which has a lateral flat which cooperates as a counterthrust member with the flat face of a spring-loaded thrusting piston which in turn is disposed for displacement in the latch radially to the fulcrum axis.

In accordance with German Pat. No. 1,678,761, a spherical head is disposed on the fulcrum block, and on it the latch is fulcrumed. A conical detent recess is disposed in the spherical head and cooperates with a detent ball or detent piston having a conical point. The detent ball or detent piston are guided for displacement in the latch against the resistance of a detent spring and are disposed in the latch on the side thereof facing away from the ski boot. The arrangement is made such that the line of action of the detent ball or detent piston is at a radial distance above the center of the spherical head.

These known bindings, especially those described in German Petty Pat. No. 1,986,426 and in German Pat. No. 1,578,761, have a high internal friction within the resiliency range, since strong forces act on the detent members transversely of the direction of thrust of the detent members in the latches, so that the friction between the detent members and their guides increases greatly.

The result of the elevated internal friction is that, within the resiliency range, relatively high forces have to be transmitted by the boot to the latch in order to cause the latter to rock, while on the other hand, after the latch has rocked, the return forces exercised on the boot by the latch are comparatively low. Thus the binding returns to its precise clamping position only relatively slowly and, in the event of a plurality of successive shocks acting in the release direction, which of themselves are not dangerous for the skier, it may accidentally release.

In the binding in accordance with German Pat. No. 1,205,875, the friction resistance offered to the thrusting piston in the latch is somewhat lower, but on the other hand the binding is relatively soft in the area of its gripping position, since it takes a relatively great swing of the latch to produce an appreciable displacement of the thrusting piston.

Consequently it is the object of the invention to create a ski binding part corresponding to the kind described above, which within the resiliency range will be able to produce high return forces of the order of magnitude of the forces necessary for the release of the binding, while at the same time it is to be possible to produce a desired releasing characteristic.

This object is achieved by the fact that the longitudinal central axis in the direction of movement of the thrust block is at a radial distance from same below the fulcrum axis of the latch.

On the basis of this arrangement, when the latch is rocked away from its gripping position, relatively great amounts of the thrust block resistance that is to be overcome act directly in the direction of movement of the thrust block without exerting lateral forces on same tending to press the thrust block against its guides in the latch.

This brings it about advantageously that the forces which release the binding are determined essentially by the characteristics of the thruster spring as well as the configuration of the thrust block and counterthrust member, while the friction of the thrust block in the latch plays a comparatively unimportant part. At the same time, this assures a repeatable performance of the binding.

Great freedom can be exercised in the configuration of the thrust block and counterthrust member, so that any desired release characteristic is easily achieved.

For example, a lobe can be provided on the thrust block for cooperation with a cam surface provided on the fulcrum block as the counterthrust member against which the thrust block is biased by the thrust spring.

In a preferred embodiment of the invention, the lobe can be disposed below the longitudinal central axis of the thrust block.

It is also possible to cause a lobe-like cam follower on the fulcrum piece to cooperate with a cam surface on the thrust block.

In this case, in accordance with a preferred embodiment of the invention, the arrangement is made such that the cam surface provided on the thrust block engages the cam follower at a point that is below the central longitudinal axis of the thrust block when the ski binding part is in the gripping position.

The cam surface can desirably have two sections disposed one on either side of a crest, with their surface portions falling away from the fulcrum axis with increasing distance from the crest.

On the basis of this arrangement, the cam surface cooperates with the cam follower lobe such that the latch is forced back to its gripping position when one section cooperates with the follower lobe (resiliency range), while the latch is acted on in the opening direction when the other section engages the follower lobe.

Preferably, a portion of the fulcrum end of the thrust spring is to act as an abutment which cooperates with a part, such as the heel spur, on the latch and limits the tilt of the latch in the direction opposite the release direction. This measure prevents the latch from striking forcibly against the fulcrum piece when the latch is tripped to its gripping position after the ski boot has been removed from the binding. In this case the thrust spring serves as a correspondingly resilient abutment. An additional resilient buffer or the like thus becomes unnecessary.

Figure 2:
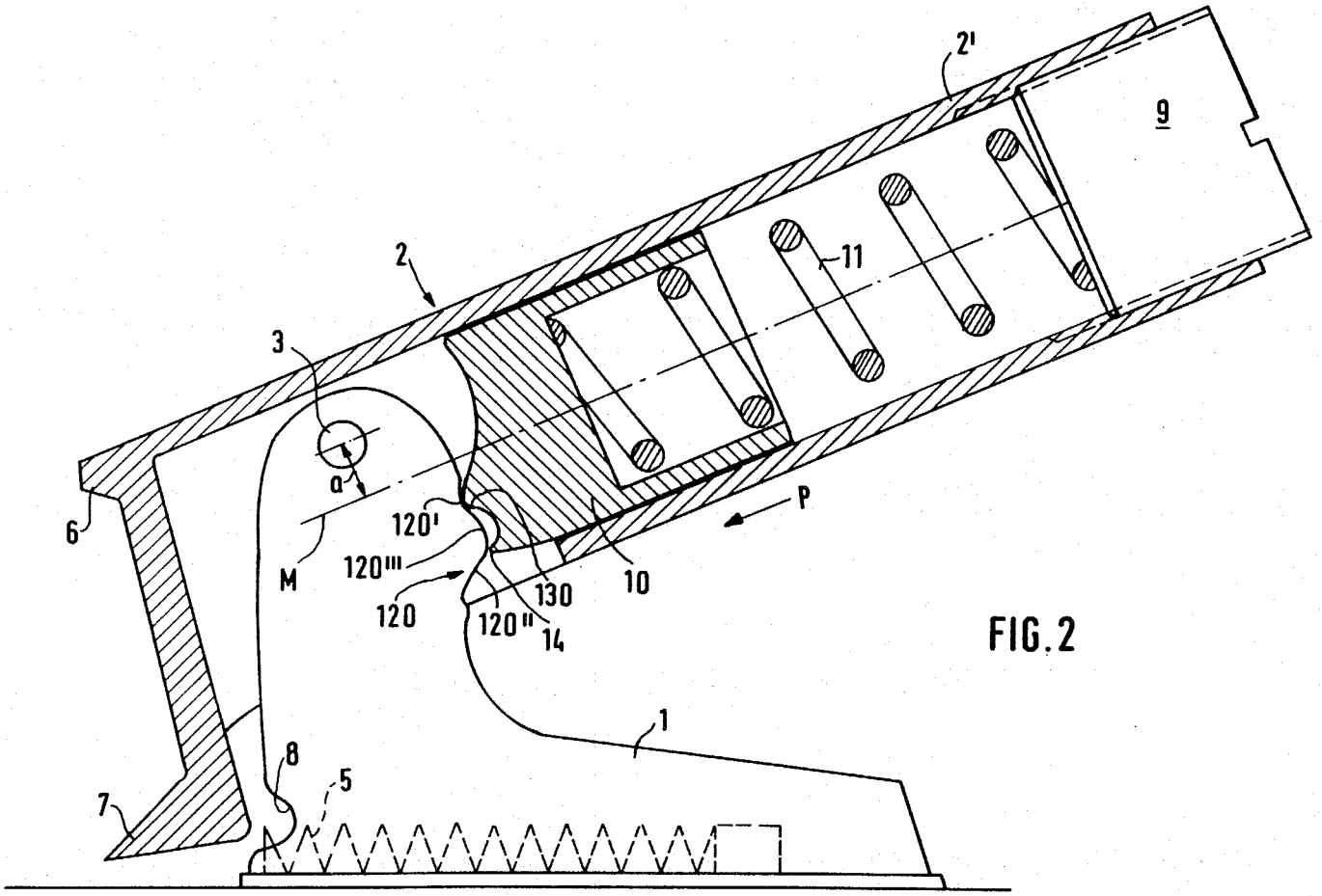
Figure 3:
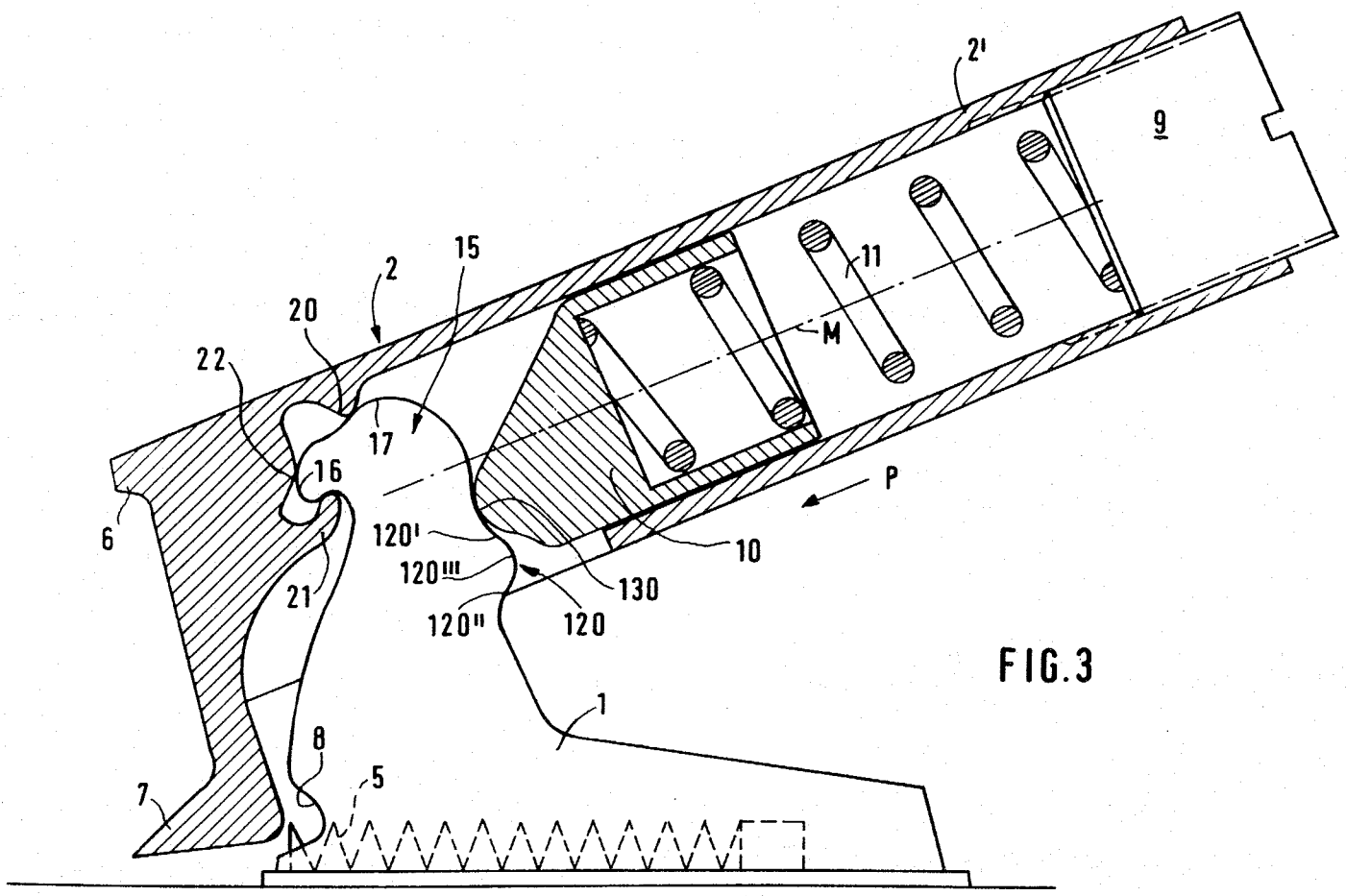
Figure 4:
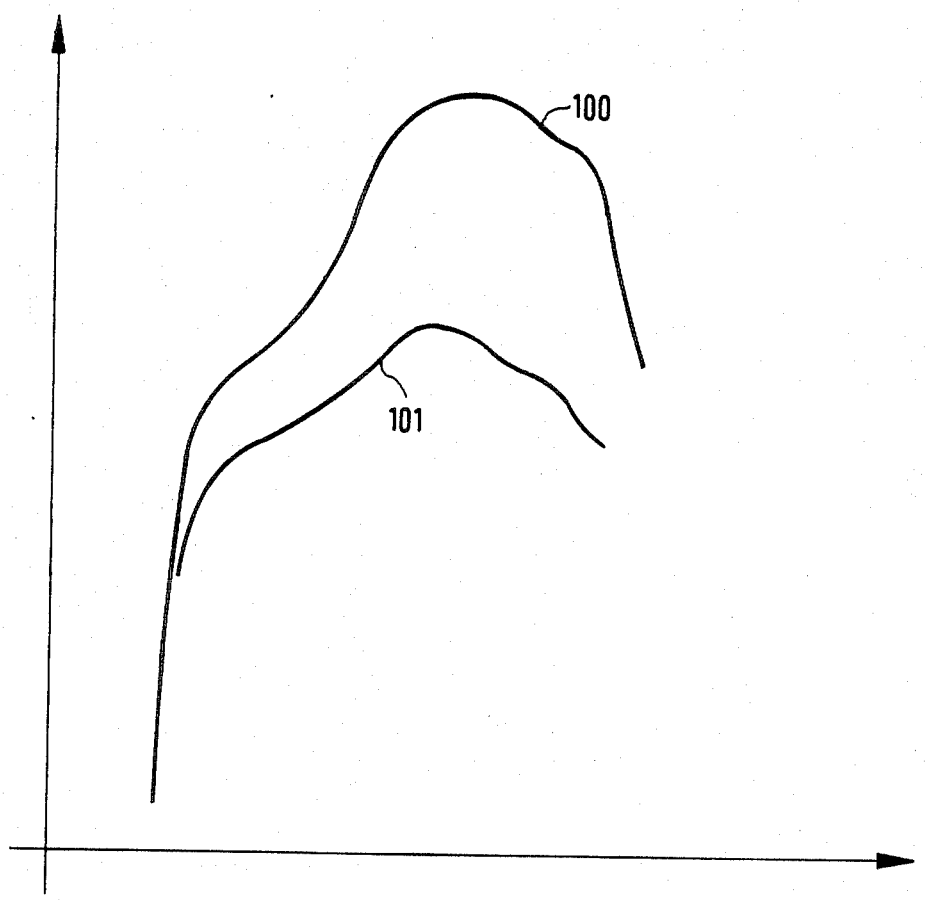

The invention will be explained hereinafter in conjunction with preferred embodiments which are represented in the appended drawings, wherein FIG. 1 is a side view, partially in cross section, of a first embodiment, FIG. 2 is a similar view of another embodiment, FIG. 3 is a similar view of a third embodiment, and FIG. 4 is an exemplary diagram showing the forces which have to be applied in order to bring the latch into a position pivoted from the gripping position; this diagram also shows the return forces occurring in each angular position.

In FIG. 1, a ski binding part in accordance with the invention has a fulcrum block 1 on which a latch 2 is disposed for pivoting on pins, bolts or the like about a fulcrum axis disposed at right angles to the ski length.

The fulcrum block 1 is disposed for displacement lengthwise of the ski in guides 4 and is biased to the left in FIG. 1 against a ski boot, which is not represented, by means of a spring 5 which is held between a part affixed to the ski and the fulcrum block 1. The displaceability of the fulcrum block 1 serves in a known manner to permit or help the ski to flex in the area of the boot sole when the skier passes over irregularities in the ground.

The latch 2 is shown in its boot gripping position, in which its projection 6 overreaches the heel of a ski boot which is not represented, and its heel spur 7 extends beneath the heel. The ability of the latch 2 to pivot counterclockwise about the axis 3 is limited by the interaction of the heel spur 7 with the bias spring 5, whose left end in FIG. 1, which is braced against the fulcrum block 1 and projects from an opening 8 in the fulcrum block 1, and which serves as a resilient abutment for the heel spur 7. This cushions any clash between parts of the latch and parts of the fulcrum block 1.

The portion 2' on the end of the latch 2, opposite the projection 6 is of cylindrical configuration and its free end is closed by a threaded adjusting plug 9. A piston-like thrust block 10 is displaceably guided in portion 2' and is biased in the direction of the arrow P by a thrusting spring 11 held between the thrust block 10 and the plug 9. The thrust block 10 has at a cam surface 12 cooperating with a cam follower lobe 13 fixedly disposed on the fulcrum block 1, such that the latch 2 seeks to rotate to the gripping position illustrated, when portion 12' is engaged with the cam follower lobe 13, while the latch 2 will seek to rock clockwise to its open position when the portion 12'' of the cam surface 12 cooperates with the lobe 13. For this purpose sections 12' and 12'' of the cam surface 12 are disposed such that the distance R between the fulcrum axis 3 and the cam surface 12 increases with increasing distance from a crest 12''' provided between the portions 12' and 12''.

It is especially important that the central longitudinal axis M running in the direction of movement of the piston-like thrust block 10 is at a radial distance a below the fulcrum axis 3 of the latch 2. When the latch 2 rocks, the forces exerted on the cam follower lobe 13 by the piston-like thrust block under the bias of the thrusting spring 11 act mainly in the direction of displacement of the thrust block 10, while the forces which seek to drive the thrust block 10 transversely of the longitudinal central axis M, against the guiding walls of the latch 2, are comparatively slight.

Thus only relatively slight friction occurs between the latch 2 and the piston-like thrust block 10 when the latter is displaced. As a result, the return forces produced by the cooperation of portion 12' of cam surface 12 and the cam follower lobe 13 have a magnitude comparable to that of the forces which have to be exerted in order to rock the latch 2 slightly away from the represented gripping position.

The embodiment represented in FIG. 2 differs from that of FIG. 1 essentially in that, on the piston-like thrust block 10 there is provided a cam follower lobe 130 which cooperates with a cam surface 120 fixedly provided on the fulcrum block 1 and which in turn has portions 120' and 120'' which are disposed one on either side of a crest 120''', a torque in the direction of the gripping position illustrated acts on the latch 2 while the lobe 130 is in engagement with the portion 120'. When the lobe 130 cooperates with the portion 120'' a torque in the reverse direction is produced.

Furthermore, a lip 14 is provided on the thrust block 10, which, when the ski binding part is in the gripping position, lies against the cam surface 120 and protects portion 120' against dirt entering from below.

What is important is that in this embodiment too, the longitudinal central axis M of the piston-like thrust block 10 passes at a distance a below the fulcrum axis 3.

The embodiment represented in FIG. 3 is substantially the same as that of FIG. 2, but the configuration of the articulation between fulcrum block 1 and latch 2 is different. Fulcrum block 1 has a head 15 having arcuate surface portions 16 and 17 which can be straddled by ridges 20 and 21 on the latch 2, running transversely of the ski length. Between the ridges 20 and 21 there is a recess having a convex portion 22 which rests on portion 16 of the head 15, since the latch 2 is urged rightwardly by the thrusting spring 11. When the latch 2 is rocked in a counterclockwise direction, the convex portion 22 and the portion 16 roll on one another, and at the same time the ridges 20 and 21 in cooperation with the portions 16 and 17 prevent the latch 2 from slipping off from the head 15 of the fulcrum block 1. An advantage of this embodiment is that, when the latch 2 is rocked, little sliding friction takes place between it and the head 15. Furthermore, assembly is simplified, since the latch 2 need only be superimposed on the head 15 and there is no need for any separate fastening means such as pins or the like.

FIG. 4 shows a diagram in which the displacement of the latch 2 with respect to its clamping position represented in FIGS. 1 to 3 is recorded for arbitrary angles on the abscissas. The forces are recorded on the ordinates in arbitrary units. Curve 100 gives the forces which are to be applied for the movement of the latch 2 in the opening direction. Curve 101 shows the return forces which seek to return the latch from an excursion to the gripping position. On the basis of the construction features in accordance with the invention, curves 100 and 101 have a similar shape and show in the direction of the ordinates a very slight distance in comparison with the state of the art, this distance being typical of the invention.

I claim:

1. Ski binding part, especially a heel gripper having a fulcrum block mounted on a ski, a latch fulcrumed on the fulcrum block about at least one fulcrum axis disposed transversely to the ski length, said latch in a gripping position overreaching a boot part, and a thrusting mechanism comprising a thrust block disposed on the side facing away from the boot and displaceably guided like a piston-part on the latch transversely of its fulcrum axis, a thrusting spring against the force of which said thrust block is guided, and a counter-thrust member fixedly disposed on the fulcrum block cooperable with said thrust block such that, within a resiliency range of the ski binding part, upon a rocking of the latch in a boot releasing direction, a resistance producing a return moment is offered, which greatly diminishes upon the further rocking of the latch beyond the resiliency range, said fulcrum axis (3, 16, 22) being disposed with respect to a central longitudinal axis (M) of the thrust block running in the direction of displacement of the thrust block (10) at a radial interval (a) above said longitudinal axis, and a thrust point between the thrust block (10) and the counter-thrust member (13, 120) in the gripping position lying on the other side of the central longitudinal axis.

2. Ski binding part according to claim 1, characterized in that a cam-like portion (130) disposed on the thrust block (10) cooperates with a cam-like control surface (120) as a counterthrust member, and is biased against the counterthrust member by the thrusting spring (11).

3. Ski binding portion of claim 2, characterized in that the cam-like part (130) is disposed below the central longitudinal axis of the thrust block (10).

4. Ski binding part of claim 1, characterized in that a cam-like part (13) affixed to the fulcrum block cooperates with a cam-like control surface (12) affixed to the thrust block (10).

5. Ski binding part of any of claims 2 to 4, characterized in that the control surface (12, 120), as seen in the axial direction of the fulcrum axis (3), has two sections (12', 12'' and 120', 120'') disposed one on either side of a crest (12''', 120'''), the surface parts of which have a distance (R) with respect to the fulcrum axis (3) which increases with increasing distance from the crest (12''', 120''').

6. Ski binding part of claim 1, characterized in that on the thrust block (10), below the contacting areas of the thrust block (10) and counterthrust member (12, 130), there is disposed a lip (14) which engages the counterthrust member.

7. Ski binding part of claim 1, characterized in that the latch (2) is fulcrumed by means of rodlike parts such as pivots or pins on the fulcrum block (1).

8. Ski binding part of claim 1, characterized in that on the fulcrum block (1) there is disposed a cylindrical or spherical articulation head (15) on which the latch (2) is rockingly mounted by means of socket-like joint parts disposed thereon.

9. Ski binding part of claim 8, characterized in that the articulation head (15) and the joint part of the latch (2) which encompasses it on the side of the fulcrum block (1) facing away from the thrust block (10) have concave surface sections (16, 22) rolling on one another when the latch (2) rocks in relation to the fulcrum block (1).

* * * * *